US010422523B2

(12) United States Patent
Wiklof

(10) Patent No.: US 10,422,523 B2
(45) Date of Patent: Sep. 24, 2019

(54) IONIZER FOR A COMBUSTION SYSTEM

(71) Applicant: ClearSign Combustion Corporation, Seattle, WA (US)

(72) Inventor: Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 538 days.

(21) Appl. No.: 15/090,483

(22) Filed: Apr. 4, 2016

(65) Prior Publication Data

US 2016/0215974 A1 Jul. 28, 2016

Related U.S. Application Data

(63) Continuation of application No. PCT/US2014/059358, filed on Oct. 6, 2014.

(60) Provisional application No. 61/887,333, filed on Oct. 4, 2013.

(51) Int. Cl.
*F23C 99/00* (2006.01)
*F23D 14/68* (2006.01)

(52) U.S. Cl.
CPC ..... *F23C 99/001* (2013.01); *F23D 14/68* (2013.01)

(58) Field of Classification Search
CPC ..... F23C 99/001; F23D 14/84; F23D 14/68
USPC ..... 431/253
See application file for complete search history.

(56) References Cited

U.S. PATENT DOCUMENTS 2,374,610 A 4/1945 MacLaren, Jr.
2,604,936 A * 7/1952 Kaehni ..... F23C 99/001 122/14.21
3,004,137 A 10/1961 Karlovitz
3,087,472 A 4/1963 Yukichi
3,167,109 A 1/1965 Wobig
3,224,485 A * 12/1965 Blomgren, Sr. ..... F23C 99/001 165/903
3,306,338 A 2/1967 Wright et al.
3,373,306 A 3/1968 Karlovitz
3,416,870 A 12/1968 Wright
(Continued)

FOREIGN PATENT DOCUMENTS

EP 0844434 5/1998
EP 2738460 6/2014
(Continued)

OTHER PUBLICATIONS

PCT International Search Report and Written Opinion of International PCT Application No. PCT/US2014/059358 dated Jan. 20, 2015.

(Continued)

*Primary Examiner* — Avinash A Savani
*Assistant Examiner* — Aaron H Heyamoto
(74) *Attorney, Agent, or Firm* — Christopher A. Wiklof; Nicholas S. Bromer; Launchpad IP, Inc.

(57) ABSTRACT

A combustion system includes an ionizer configured to eject charges (or accept charges) for uptake by a combustion reaction to cause a combustion reaction to carry a majority charge or voltage. The ionizer includes an inner electrode, a dielectric body surrounding the inner electrode, and one or more conductive or semi-conductive inner electrodes disposed on the surface of the dielectric body. The inner and outer electrodes are configured to be in a capacitive relationship.

30 Claims, 9 Drawing Sheets

(56) References Cited

U.S. PATENT DOCUMENTS

| | | | | |
|---|---|---|---|---|
| 3,749,545 | A | 7/1973 | Velkoff | |
| 4,052,139 | A | 10/1977 | Paillaud et al. | |
| 4,111,636 | A | 9/1978 | Goldberg | |
| 5,702,244 | A | 12/1997 | Goodson et al. | |
| 5,784,889 | A | 7/1998 | Joos et al. | |
| 6,247,921 | B1 | 6/2001 | Helt | |
| 6,374,909 | B1 | 4/2002 | Jeter et al. | |
| 6,786,716 | B1 * | 9/2004 | Gardner | F23C 13/00 431/268 |
| 7,137,808 | B2 | 11/2006 | Branston et al. | |
| 7,159,646 | B2 | 1/2007 | Dessiatoun et al. | |
| 7,243,496 | B2 | 7/2007 | Pavlik et al. | |
| 7,523,603 | B2 | 4/2009 | Hagen et al. | |
| 7,845,937 | B2 | 12/2010 | Hammer et al. | |
| 8,082,725 | B2 | 12/2011 | Younsi et al. | |
| 8,851,882 | B2 | 10/2014 | Hartwick et al. | |
| 9,209,654 | B2 | 12/2015 | Colannino et al. | |
| 9,243,800 | B2 | 1/2016 | Goodson et al. | |
| 9,284,886 | B2 | 3/2016 | Breidenthal et al. | |
| 9,366,427 | B2 | 6/2016 | Sonnichsen et al. | |
| 9,371,994 | B2 | 6/2016 | Goodson et al. | |
| 9,377,188 | B2 | 6/2016 | Ruiz et al. | |
| 9,377,189 | B2 | 6/2016 | Ruiz et al. | |
| 9,377,195 | B2 | 6/2016 | Goodson et al. | |
| 9,453,640 | B2 | 9/2016 | Krichtafovitch et al. | |
| 9,469,819 | B2 | 10/2016 | Wiklof | |
| 9,696,031 | B2 | 7/2017 | Goodson et al. | |
| 9,702,550 | B2 | 7/2017 | Colannino et al. | |
| 9,746,180 | B2 | 8/2017 | Krichtafovitch et al. | |
| 2002/0088442 | A1 | 7/2002 | Hansen et al. | |
| 2005/0208442 | A1 | 9/2005 | Heiligers et al. | |
| 2005/0208446 | A1 | 9/2005 | Jayne | |
| 2006/0165555 | A1 | 7/2006 | Spielman et al. | |
| 2007/0020567 | A1 * | 1/2007 | Branston | F02M 27/04 431/8 |
| 2010/0183424 | A1 | 7/2010 | Roy | |
| 2011/0018544 | A1 | 1/2011 | Bertelli | |
| 2011/0203771 | A1 * | 8/2011 | Goodson | F15D 1/02 165/96 |
| 2012/0156628 | A1 | 6/2012 | Lochschmied et al. | |
| 2012/0276487 | A1 | 11/2012 | Hangauer et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0260321 | A1 | 10/2013 | Colannino et al. | |
| 2013/0323661 | A1 | 12/2013 | Goodson et al. | |
| 2014/0051030 | A1 | 2/2014 | Colannino et al. | |
| 2014/0170571 | A1 | 6/2014 | Casasanta, III et al. | |
| 2014/0208758 | A1 | 7/2014 | Breidenthal et al. | |
| 2014/0227646 | A1 | 8/2014 | Krichtafovitch et al. | |
| 2015/0079524 | A1 | 3/2015 | Colannino et al. | |
| 2015/0107260 | A1 | 4/2015 | Colannino et al. | |
| 2015/0118629 | A1 | 4/2015 | Colannino et al. | |
| 2015/0121890 | A1 | 5/2015 | Colannino et al. | |
| 2015/0140498 | A1 | 5/2015 | Colannino | |
| 2015/0147705 | A1 | 5/2015 | Colannino et al. | |
| 2015/0219333 | A1 | 8/2015 | Colannino et al. | |
| 2015/0338089 | A1 | 11/2015 | Krichtafovitch et al. | |
| 2015/0345781 | A1 | 12/2015 | Krichtafovitch et al. | |
| 2015/0362177 | A1 | 12/2015 | Krichtafovitch et al. | |
| 2016/0018103 | A1 | 1/2016 | Karkow et al. | |
| 2016/0040872 | A1 | 2/2016 | Colannino et al. | |
| 2016/0040946 | A1 | 2/2016 | Goodson et al. | |
| 2016/0123577 | A1 | 5/2016 | Dumas et al. | |
| 2016/0161110 | A1 | 6/2016 | Krichtafovitch et al. | |
| 2016/0290633 | A1 | 10/2016 | Cherpeske et al. | |
| 2018/0051874 | A1 | 2/2018 | Dumas | |

FOREIGN PATENT DOCUMENTS

| | | |
|---|---|---|
| FR | 2577304 | 12/1989 |
| GB | 932955 | 7/1963 |
| GB | 1042014 | 9/1966 |
| JP | 58-019609 | 2/1983 |
| JP | 60-216111 | 10/1985 |
| JP | 61-265404 | 11/1986 |
| JP | H 07-48136 | 2/1995 |
| JP | 2001-021110 | 1/2001 |
| WO | 96/01394 | 1/1996 |
| WO | WO 2015/017084 | 2/2015 |
| WO | WO 2016/018610 | 2/2016 |

OTHER PUBLICATIONS

F. Altendorfner et al., Electric Field Effects on Emissions and Flame Stability with Optimized Electric Field Geometry, The European Combustion Meeting ECM 2007, 2007, Fig. 1, Germany.

Timothy J.C. Dolmansley et al., "Electrical Modification of Combustion and the Affect of Electrode Geometry on the Field Produced," Modelling and Simulation in Engineering, May 26, 2011, 1-13, vol. 2011, Himdawi Publishing Corporation.

James Lawton and Felix J. Weinberg. "Electrical Aspects of Combustion." Clarendon Press, Oxford. 1969, p. 158.

* cited by examiner

IONIZER FOR A COMBUSTION SYSTEM

CROSS REFERENCE TO RELATED APPLICATIONS

The present application is a U.S. Continuation Application which claims priority benefit under 35 U.S.C. § 120 (pre-AIA) of co-pending International Patent Application No. PCT/US2014/059358, entitled "IONIZER FOR A COMBUSTION SYSTEM," filed Oct. 6, 2014; which application claims priority benefit from U.S. Provisional Patent Application No. 61/887,333, entitled "ION SOURCE FOR A COMBUSTION SYSTEM," filed Oct. 4, 2013, each of which, to the extent not inconsistent with the disclosure herein, is incorporated herein by reference.

BACKGROUND

Combustion systems typically include a fuel source and oxidant source. The fuel and oxidant are mixed together in a combustion chamber and a combustion reaction is initiated and sustained. The heat from the combustion reaction can be used to generate electricity, to heat materials in industrial processes, to drive endothermic chemical reactions, and many other applications. The characteristics of a combustion reaction determine how effectively these purposes can be carried out. It is desirable to be able to manipulate a combustion reaction in a selected manner to improve the effectiveness of the combustion reaction.

SUMMARY

One embodiment is a combustion system including a fuel source and burner for initiating and maintaining a combustion reaction in a combustion volume. An ionizer is positioned adjacent the combustion reaction, separated from the combustion reaction by a gap including a dielectric gas. The ionizer includes an inner electrode coupled to a high-voltage power source. The inner electrode is covered by a dielectric body. An electrode is positioned on an outer surface of the dielectric body and electrically insulated from the inner electrode by the dielectric body. The electrode is nevertheless capacitively coupled to the inner electrode. When the power source supplies a high-voltage to the inner electrode, a high-voltage is similarly induced on the electrode via the capacitive coupling. The high-voltage on the electrode can be used to manipulate a characteristic of the combustion reaction.

In one embodiment, the combustion system includes a counter electrode positioned in or near the combustion reaction. The counter electrode is coupled to the power supply and configured to receive a second voltage from the power supply. The second voltage is imparted to the combustion reaction by the counter electrode, which is electrically coupled to the combustion reaction. In one embodiment, the second voltage is ground. By applying respective voltages to the counter electrode and the inner electrode, the combustion reaction can be manipulated to obtain a desired effect.

DETAILED DESCRIPTION

Figure 1:
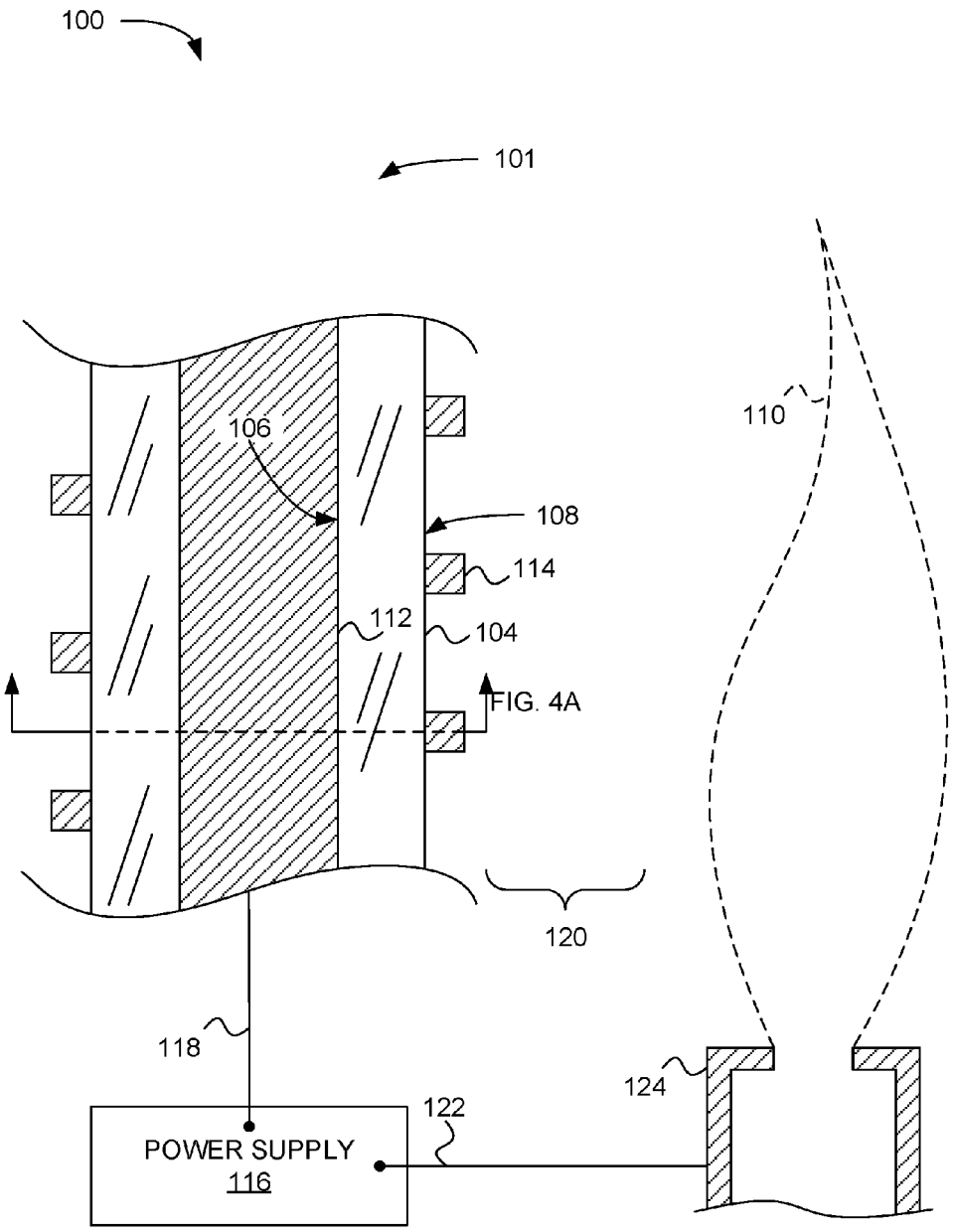
FIG. 1 is a diagram of a combustion system including an ionizer to apply an electrical potential to a combustion reaction, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a diagram of a combustion system 100 including an ionizer 101 to apply an electrical potential to a combustion reaction 110, according to an embodiment. As used herein, the term "ionizer" refers to an apparatus configured to generate charged particles, which can be ions (atoms including an atomic nucleus and missing or additional electron(s)) or electrons. The ionizer 101 for a combustion system 100 includes an inner electrode 112 and a dielectric body 104 having an inside surface 106 and an outside surface 108. The dielectric body 104 is configured to maintain high electrical resistance in the presence of a combustion reaction 110. The inner electrode 112 is disposed inside the dielectric body 104, the inner electrode 112 being electrically insulated from the combustion reaction 110. One or more outer electrodes 114 are disposed outside the dielectric body 104 in capacitive communication through the dielectric body 104 with the inner electrode 112. A high voltage power supply 116 has first and second voltage output nodes 118, 122 operatively coupled to the inner electrode 112 and to a conductive combustion support structure 124, respectively.

The power supply 116 can apply a periodic voltage signal to the inner electrode 112 via the voltage output node 118. The periodic voltage signal can be selected to cause ejection of electrical charges between the one or more outer electrodes 114 and a dielectric gap 120 disposed between the outer electrodes 114 and the combustion reaction 110. In some embodiments, the dielectric gap 120 includes a gas that acts as a dielectric to prevent direct electrical continuity between the combustion reaction 110 and the electrodes 114. In some embodiments, a source of cool gas can maintain a flow of cool gas in the dielectric gap 120. For example, the cool gas can include combustion air. In some embodiments, ejection of electrical charges can be periodic and synchronous with the periodic voltage.

The periodic voltage signal can include a first portion characterized by a positive voltage. The outer electrodes 114 can receive electrons from the dielectric gap 120 during the positive voltage portion of the periodic voltage signal, resulting in ejection of a positive charged particle. The periodic voltage signal can include a second portion characterized by a negative voltage. The outer electrode 114 can eject electrons into the dielectric gap 120 during the negative voltage portion of the periodic voltage signal.

The high voltage power supply 116 can be configured to output a periodic voltage signal having a peak-to-peak difference of 40,000 volts or more. In some embodiments, the high voltage power supply 116 can be configured to output a periodic voltage signal having a peak-to-peak difference of 100,000 volts or more. Optionally, the power supply 116 can apply an asymmetric waveform including a first portion having one polarity configured to eject charged particles of the same polarity, and a second portion of opposite polarity at a voltage insufficient to eject charged particles of the opposite polarity. Moreover, as will be described below, the ionizer 101 can be structured to preferentially eject charged particles having a selected polarity (e.g., by doping the outer electrodes 114).

The periodic voltage signal can include an alternating current (AC) voltage waveform. Additionally or alternatively, the periodic voltage signal can include a direct current (DC) chopped voltage waveform. The DC chopped voltage waveform can be DC offset from voltage ground. The DC chopped voltage waveform can include a square or a sawtooth waveform, for example.

In one embodiment, the dielectric body 104 can include fused quartz. Alternatively, another suitable dielectric material can be used for the dielectric body 104.

In one embodiment, the combustion support structure 124 is a fuel nozzle configured to emit fuel and hold the combustion reaction 110. Alternatively, the combustion support structure 124 can include a flame holder disposed adjacent to or in a fuel jet and configured to hold the combustion reaction 110. The combustion support structure 124 can be disposed for at least periodic electrical continuity with the combustion reaction 110 by which a voltage can be imparted to the combustion reaction from the high voltage power supply 116. The combustion support structure 124 can receive ground voltage, or another voltage signal, from the high voltage power supply 116 via the voltage supply node 122. Additionally or alternatively, the combustion support structure 124 can be electrically isolated from electrical ground.

In various embodiments, the inner electrode 112 can include a solid conductor, a metal mesh, a stranded structure, stainless steel, and/or a superalloy such as Inconel.

The one or more outer electrodes 114 can be shaped to cause an electric field curvature in the dielectric gap 120 disposed between the outer electrode 114 and the combustion reaction 110. In some embodiments, the one or more outer electrodes 114 can be shaped to have a lateral extent less than about 0.10 inch. In some embodiments, the one or more outer electrodes 114 can be shaped to have a lateral extent less than about 0.02 inch in at least one dimension along the outside surface 108 of the dielectric body 104. The one or more outer electrodes 114 can include a metal, stainless steel, and/or Inconel.

Figure 2:
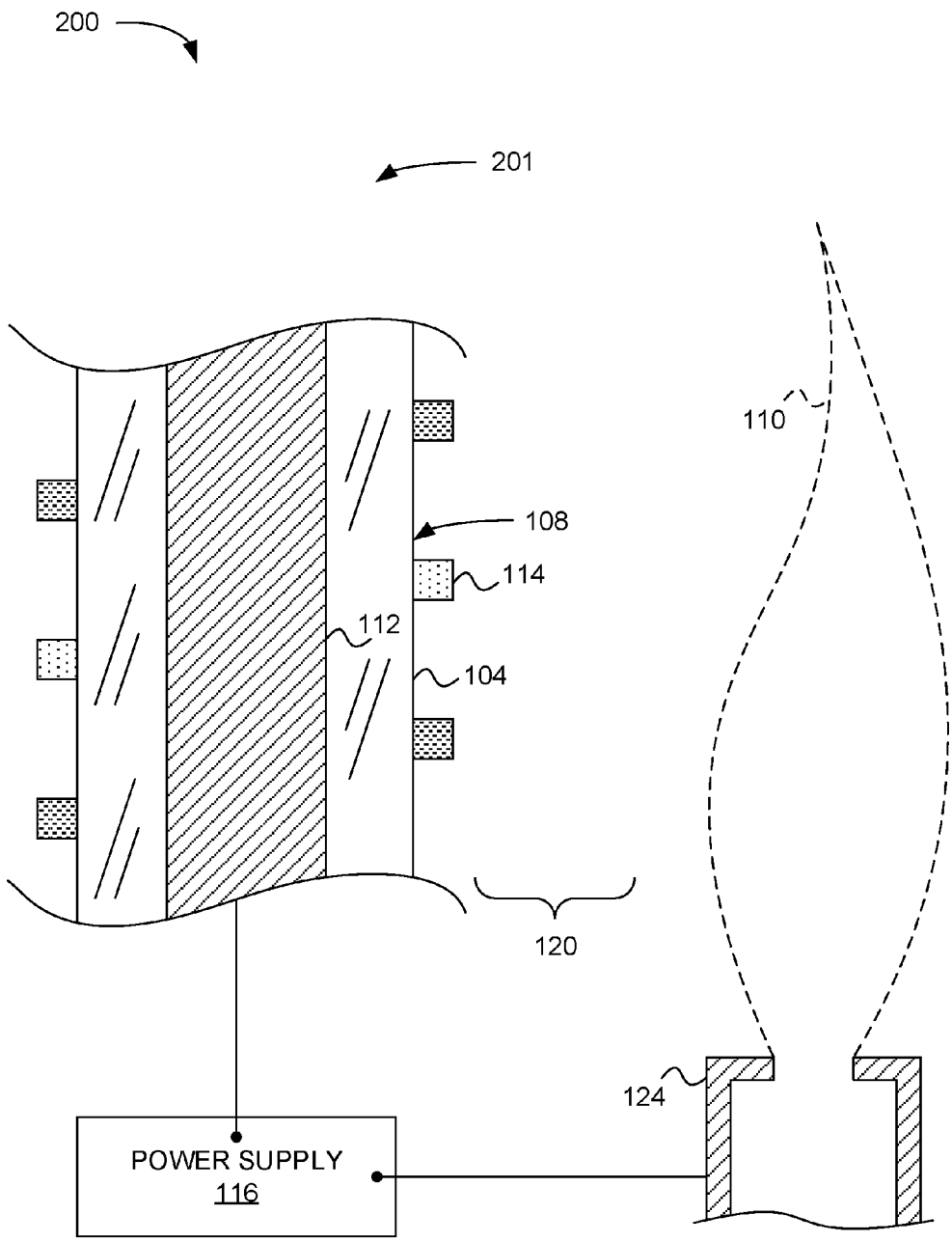
FIG. 2 is a diagram of a combustion system including an ionizer to apply an electrical potential to a combustion reaction, according to another embodiment.

FIG. 2 is a diagram of a combustion system 200 including an ionizer 201 to apply an electrical potential to a combustion reaction 110, according to another embodiment. The one or more outer electrodes 114 can include a semiconductor. The semiconductor can include germanium, doped germanium, silicon and/or doped silicon.

The one or more outer electrodes 114 can include a p-doped semiconductor. The one or more p-doped semiconductor electrodes 114 can be configured to receive electrons from the dielectric gap 120 adjacent to the inner electrode 112 during a time interval when the inner electrode 112 is held at a positive voltage. Additionally or alternatively, the one or more p-doped semiconductor electrodes 114 can be configured to minimize an ejection of electrons to the dielectric gap 120 adjacent to the inner electrode 112 during a time interval when the inner electrode 112 is held at a negative voltage. Additionally or alternatively, the one or more p-doped semiconductor electrodes 114 can be configured to eject positive charges to a dielectric gap adjacent to the inner electrode 112 during a time interval when the inner electrode 112 is held at a positive voltage.

The one or more outer electrodes 114 can include an n-doped semiconductor. The one or more n-doped semiconductor outer electrodes 114 can be configured to eject electrons to the dielectric gap 120 adjacent to the inner electrode 112 during a time interval when the inner electrode 112 is held at a negative voltage. Additionally or alternatively, the one or more n-doped semiconductor electrodes 114 can be configured to minimize an ejection of positive charges to the dielectric gap 120 adjacent to the inner electrode 112 during a time interval when the inner electrode 112 is held at a positive voltage.

The one or more outer electrodes 114 can include both p-doped semiconductor outer electrodes 114 and n-doped semiconductor outer electrodes 114. The one or more p-doped semiconductor outer electrodes 114 can be configured to receive electrons from a dielectric gap adjacent to the inner electrode 112 during a time interval when the inner electrode 112 is held at a positive voltage. Additionally or alternatively, the one or more n-doped semiconductor outer electrodes 114 can be configured to eject electrons into the dielectric gap 120 adjacent to the inner electrode 112 during a time interval when the inner electrode 112 is held at a negative voltage. The p-doped and n-doped semiconductor outer electrodes 114 can be arranged in an interleaved pattern on the outside surface 108 of the dielectric body 104. In this embodiment, the n-doped semiconductor outer electrode(s) 114 act(s) to increase electric field curvature around the p-doped semiconductor electrode(s) during a time interval when the inner electrode 112 can be held at a positive voltage. Additionally or alternatively, the p-doped semiconductor outer electrode(s) 114 act(s) to increase electric field curvature around the n-doped semiconductor electrode(s) 114 during a time interval when the inner electrode 112 can be held at a negative voltage.

The dielectric body 104 can include shapes other than tubular. For example, the inner electrode 112 can be configured as a planar element. The dielectric body 104 can be formed from a planar material such as two fused quartz sheets. The fused quartz sheets can be arranged superjacent and subjacent to the planar inner electrode 112 with some margin around three or more edges of the inner electrode 112. A metal lead operatively coupled to the inner electrode 112 can optionally be placed to emerge from between a margin in the quartz sheets along a fourth edge of the inner electrode 112. The edges of the subjacent and superjacent quartz sheets can be heated to fuse together, leaving an inner electrode 112 that is insulated. In an embodiment, the outer electrodes 114 can be disposed around one or more of the fused quartz edges. Placing the outer electrodes 114 in this location can, for example, help to reduce electric field shadowing of the electrodes 114 by the inner electrode 112. Other shapes may be substituted for a planar and rectangular inner electrode 112 and planar and rectangular quartz sheets.

Figure 3:
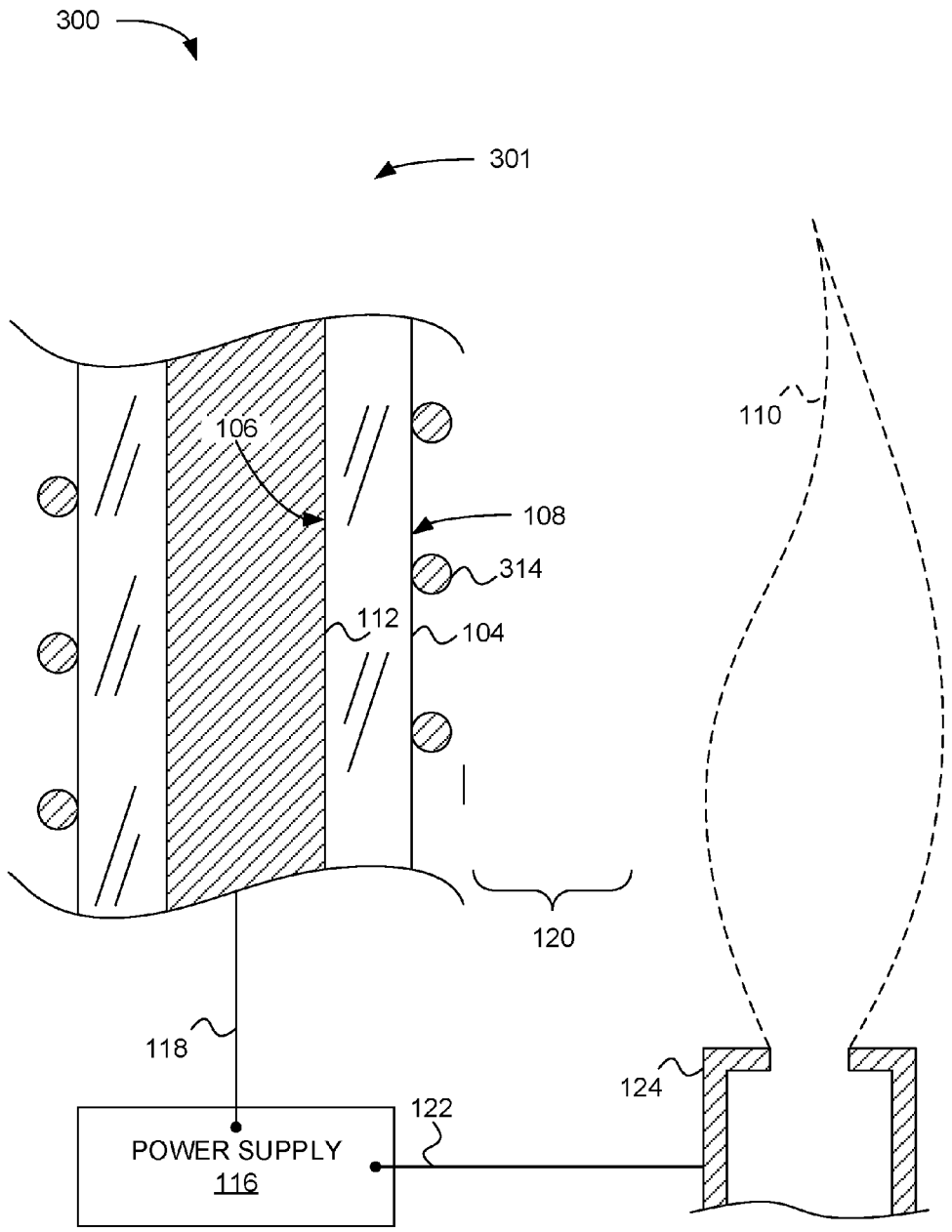
FIG. 3 is a diagram of a combustion system including an ionizer to apply an electrical potential to a combustion reaction, according to another embodiment.

FIG. 3 is a diagram of a combustion system 300 including an ionizer 301 configured to apply an electrical potential to a combustion reaction 110, according to an embodiment. The ionizer 301 is substantially similar to the ionizer 101 of FIG. 1 except that the outer electrodes 314 of FIG. 3 have a circular cross section.

In one embodiment the outer electrodes 314 are individual electrodes physically separated from each other. Alternatively, the outer electrodes 314 can all be a same thin wire wound around the ionizer 301.

Figure 4A:
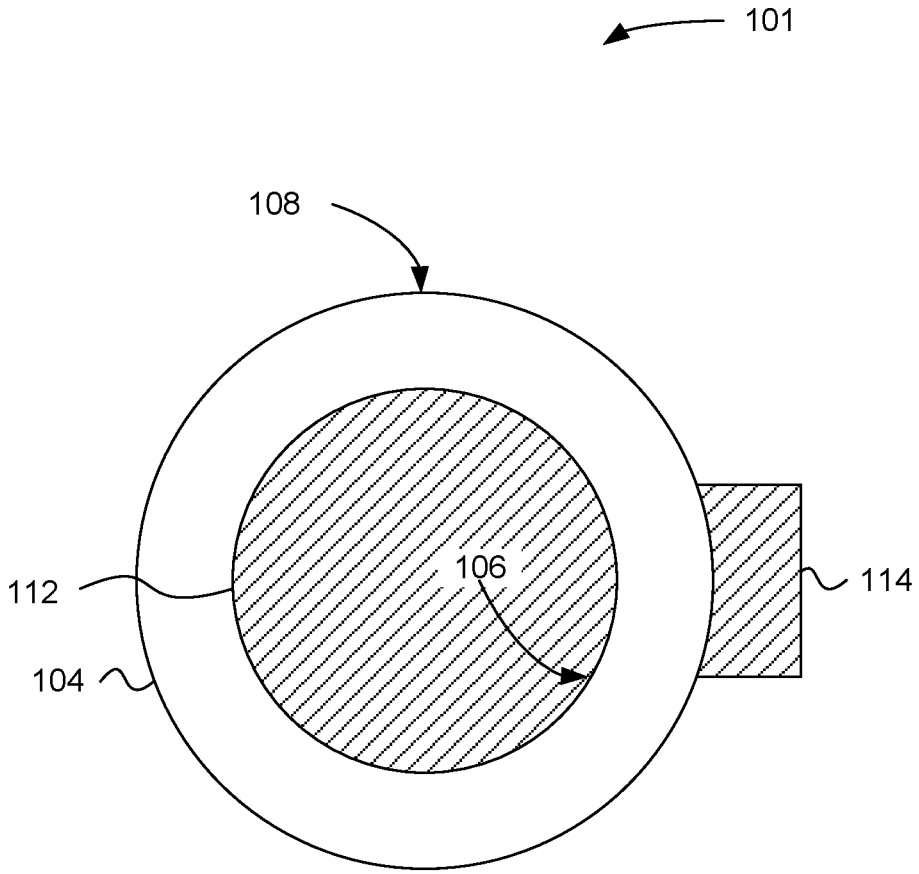
FIG. 4A is a cross sectional diagram of the ionizer, according to one embodiment.

FIG. 4A is a cross section of the ionizer 101 of FIG. 1, according to one embodiment. The ionizer 101 includes a cylindrical inner electrode 112. The cylindrical inner electrode 112 is covered by a layer of the dielectric body 104. An inside surface 106 of the dielectric body 104 is in contact with the inner electrode 112. An outer electrode 114 is positioned on an outer edge 108 of the dielectric body 104.

In the embodiment of FIG. 4A, the outer electrode 114 is a sharp electrode. The outer electrode 114 is electrically insulated from the inner electrode 112 by the dielectric body 104 such that an electrical current will not flow between the outer electrode 114 and the inner electrode 112. However, the outer electrode 114 is capacitively coupled to the inner electrode 112 via the dielectric body 104 separating the inner electrode 112 from the outer electrode 114. Due to the capacitive coupling between the inner electrode 112 and the outer electrode 114, when a voltage is applied to the inner electrode 112, the voltage on outer electrode 114 will also change. By applying a high-voltage to the inner electrode 112, a high voltage can be induced on the outer electrode 114.

When a second voltage (for example, ground voltage) is applied to a structure near the combustion reaction 110, such as the combustion support structure 124, a high charge density will accumulate at the outer edges of the outer electrode of the outer electrode 114 and particularly at the outer corners of the outer electrode 114. The high charge density can correspond to a particularly high density of electrons or the absence of electrons at the outer edges of the outer electrode 114 depending on the polarities of the voltages on the inner electrode 112 and the combustion support structure 124. For example, if the high-voltage on the outer electrode 114 has a negative polarity with respect to the combustion reaction, then a high density of electrons will accumulate at the outer edges of the outer electrode 114. If the high-voltage on the outer electrode 114 has a positive polarity with respect to the combustion reaction, then electrons will flee the outer edges of the outer electrode 114 resulting in a high density of positive charges at the outer edges of the outer electrode 114.

The high charge density at the outer edges of the outer electrode 114 results in a very strong electric field near the outer edges of the outer electrode 114. The strong electric field near the outer electrode 114 can affect the combustion reaction in various ways. The outer electrode 114 can eject charge into the combustion reaction 110 or the dielectric gap 120. The outer electrode 114 can also induce ionization of gases in the dielectric gap 120. Additionally, the electric field from the outer electrode 114 can influence the combustion reaction 110 without ejecting charges or ionizing material in the dielectric gap 120. By selecting the respective voltage polarities, respective voltage magnitudes, the width of the dielectric gap 120, and, in the case where multiple outer electrodes 114 are present, the relative positioning of the outer electrodes 114, the characteristics of the combustion reaction 110 can be manipulated in a desired manner. For example, the combustion reaction 110 can be manipulated to more thoroughly combust the fuel, to reduce pollutants, to stretch the length of the combustion reaction 110, to contract the length of the combustion reaction 110, to change color, to make the combustion reaction 110 not apparent, etc.

In one embodiment, the outer electrode 114 can be electrically connected to the power source 116. Prior to applying the high-voltage to the inner electrode 112, both the inner electrode 112 and the outer electrode 114 can be connected to ground voltage to establish a voltage relationship between the inner electrode 112 and the outer electrode 114. A switch can then electrically decouple the outer electrode 114 from the power supply 116. Due to the established capacitive relationship between the inner electrode 112 and the outer electrode 114, when the high-voltage is applied to the inner electrode 112, a high-voltage will appear on the outer electrode 114.

In one embodiment, the outer electrode(s) 114 can be produced by depositing a conductive material on the dielectric body 104 such that the dielectric body 104 is covered by the conductive material. A mask is then placed on the conductive material. The mask has a pattern according to which the outer electrode(s) 114 will be formed. With the mask covering the surface of the conductive material, the ionizer 101 is placed in a liquid etchant such as potassium hydroxide (KOH) or another suitable etchant that will selectively etch the conductive material in those areas not covered by the mask without significantly etching the dielectric body 104. When the ionizer 101 is removed from the liquid etchant and the mask is removed, the electrode(s) 114 remains. The particular etchant can be selected based on the particular materials from which the dielectric body 104 and the outer electrode(s) 114 are made.

Figure 4B:
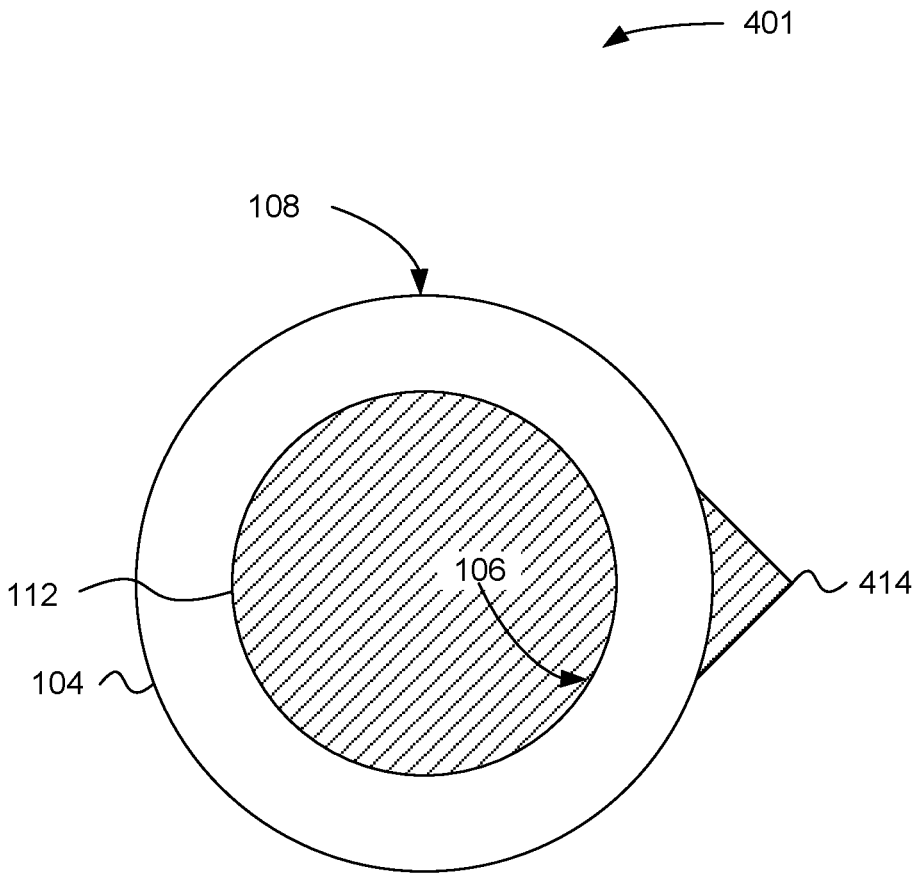
FIG. 4B is a cross sectional diagram of an ionizer, according to one embodiment.

FIG. 4B is a cross section of an ionizer 401, according to one embodiment. The ionizer 401 is substantially similar to the ionizer 101 of FIG. 4A, except that a sharp outer electrode 414 has a triangular cross section. In particular, the sharp outer electrode 414 includes a sharp point on a side of the outer electrode 114 furthest from the inner electrode 112. The ionizer 401 operates in a substantially similar manner as the ionizer 101 of FIG. 4A.

While an outer electrode having a triangular cross-section and an outer electrode having a rectangular cross-section have been disclosed, other shapes are possible for the outer electrodes 114 as will be understood by those of skill in the art in light of the present disclosure. For example, the outer electrodes 114 can have a cross-section corresponding to that of a thin rounded wire. All such other electrode shapes fall within the scope of the present disclosure.

Figure 5:
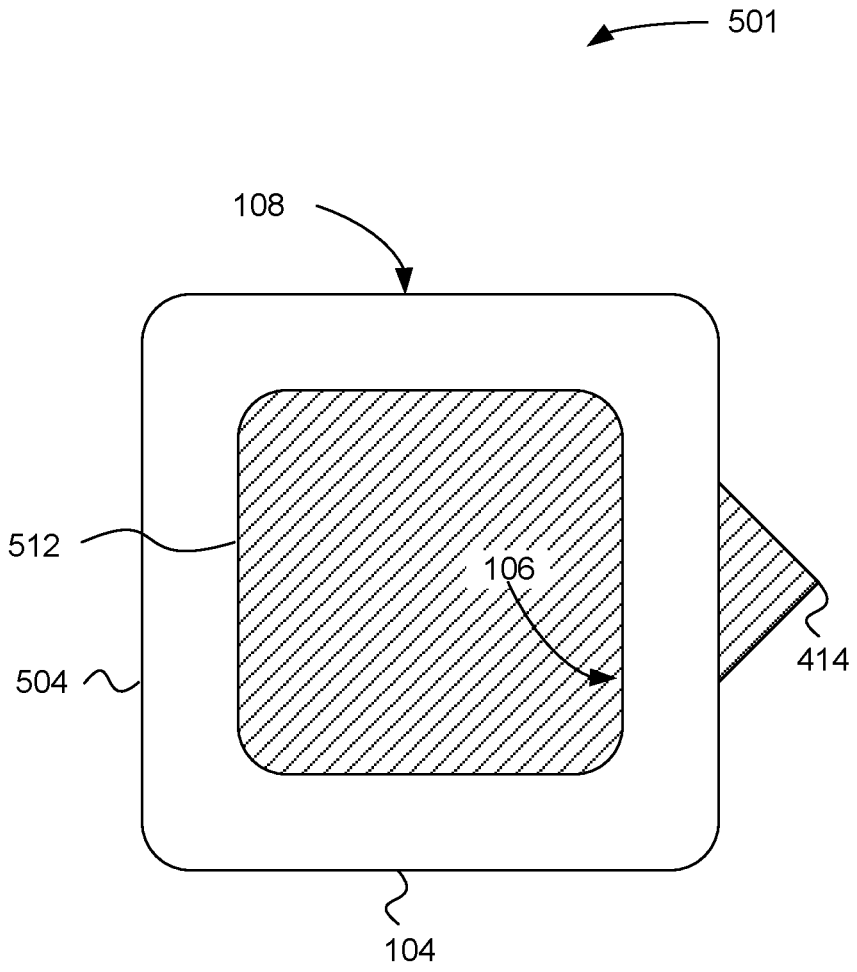
FIG. 5 is a cross sectional diagram of an ionizer, according to one embodiment.

FIG. 5 is a cross section of an ionizer 501, according to an alternate embodiment. The ionizer 501 has a substantially rectangular cross-section. In particular, an inner electrode 512 and a dielectric body 504 of the ionizer 501 have a rectangular cross-section. An outer electrode 414 is positioned on the on the dielectric body 504. Though not shown in the figures, those of skill in the art will understand, in light of the present disclosure, that many other shapes and configurations can be implemented for an ionizer in accordance with principles of the present disclosure. All such other shapes and configurations fall within the scope of the present disclosure.

Figure 6:
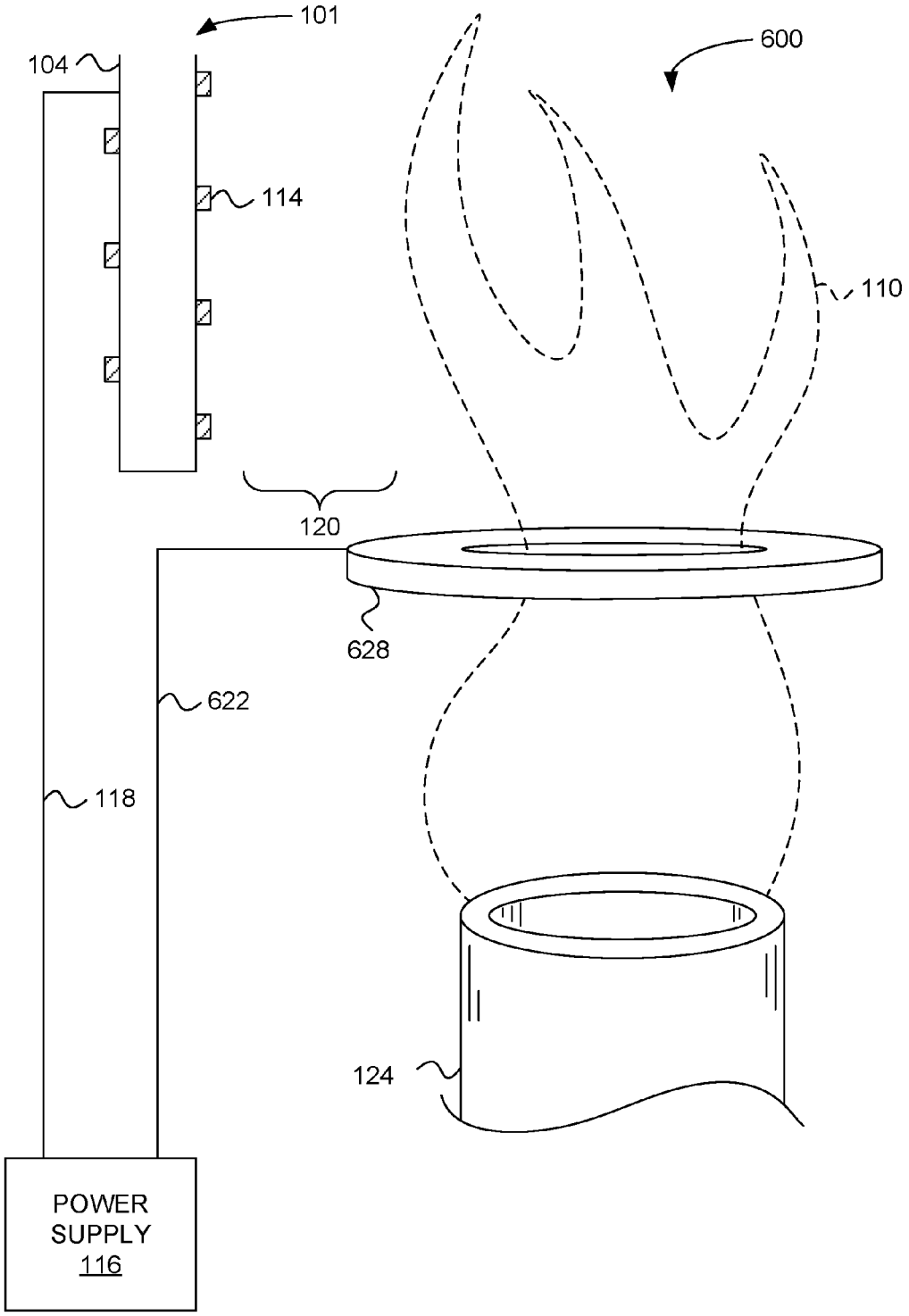
FIG. 6 is a diagram of a combustion system including an ionizer and an annular counter electrode, according to one embodiment.

FIG. 6 is a diagram showing a combustion system 600 including an ionizer 101 and a counter electrode 628, according to an embodiment. The counter electrode 628 is proximate to the combustion reaction 110. The ionizer 101 includes an inner electrode 112 (see FIGS. 1-3) and a plurality of outer electrodes 114 isolated from the inner electrode 112 by the dielectric body 104. A high voltage power supply 116 is operatively coupled to the counter electrode 628 by a voltage output node 622, and to the inner electrode 112 of the ionizer 101 by a voltage output node 118.

In the combustion system 600 of FIG. 6 the counter electrode 628 has the shape of a torus or a toroid surrounding the combustion reaction 110 and positioned a selected distance above the combustion support structure 124. In one embodiment, the counter electrode 628 lacks the sharp features of the outer electrode 114. Therefore, the strength of the electric field in the immediate vicinity of the counter electrode 628 is not as great as the strength of the electric field in the immediate vicinity of the sharp outer electrode 114. The counter electrode 628 does not tend to eject charge into or induce ionization of the surrounding dielectric medium.

In one embodiment, the counter electrode 628 is configured so that the electric field adjacent to it is about equal to or less than the average electric field magnitude in the region between outer electrodes 114 and the counter electrode 628.

The counter electrode 628 is operatively coupled to the power supply 116. In one embodiment, the counter electrode 628 can be held substantially at ground potential, or can be configured to be driven to an instantaneous voltage substantially the same as the instantaneous voltage applied to the outer electrodes 114. Alternatively, the counter electrode 628 can be configured to be galvanically isolated from ground and from other electrical potentials.

Figure 7:
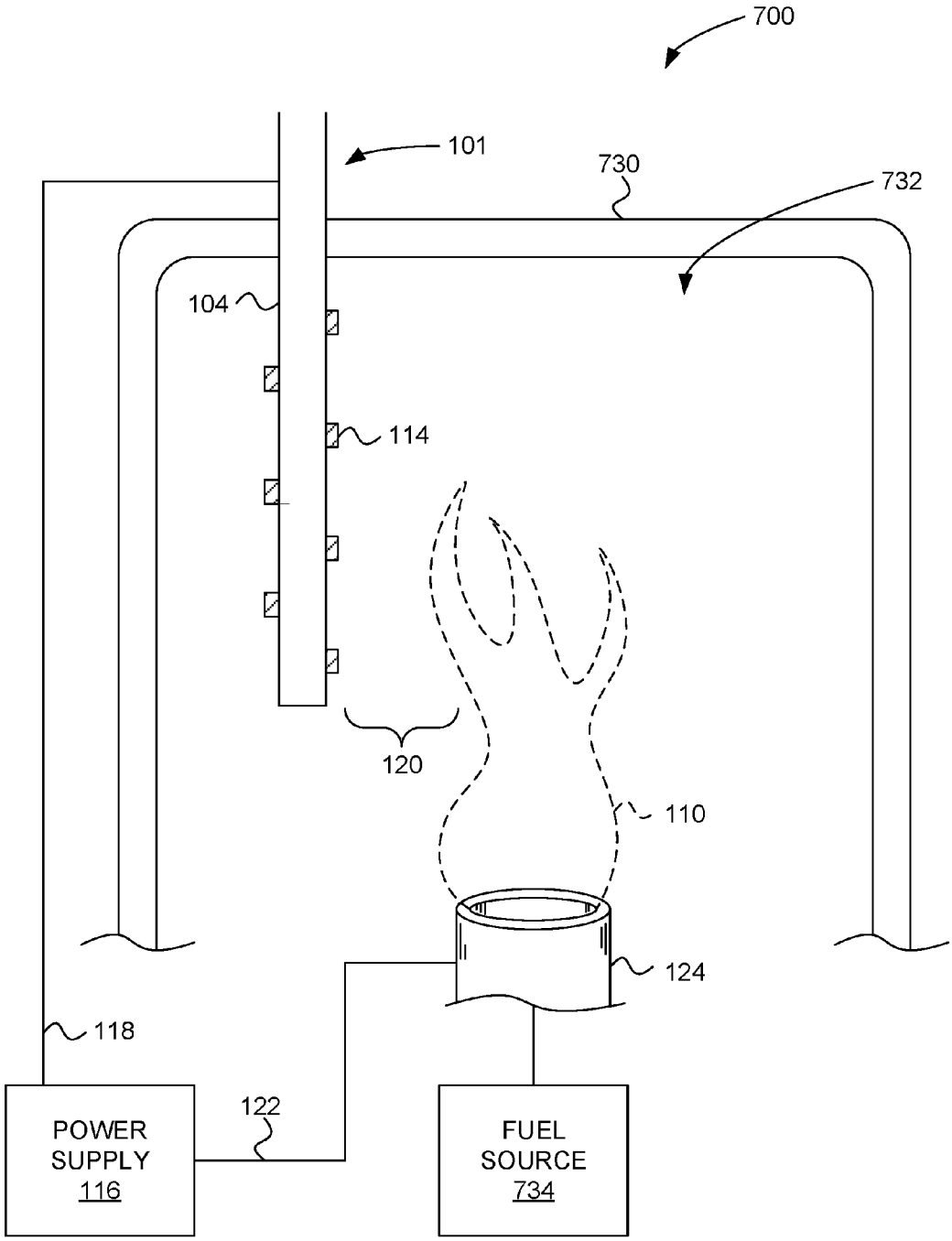
FIG. 7 is a diagram of a combustion system, according to one embodiment.

FIG. 7 is a diagram of a combustion system 700, according to one embodiment. The combustion system 700 includes a combustion wall or enclosure 730 defining an inner furnace volume 732. An ionizer 101 extends into the furnace volume 732 through an aperture in an upper portion of the wall 730. The combustion support structure 124 sustains a combustion reaction 110 within the furnace volume 732. A fuel source 734 provides fuel to the combustion support structure 124. A high-voltage power supply 116 is electrically coupled to the combustion support structure 124 into the ionizer 101.

The combustion support structure 124 is a conductive flame holder or fuel nozzle that supports the combustion reaction 110. According to one embodiment, ground voltage is applied to the conductive combustion support structure 124 by the high-voltage power supply 116. Because the combustion reaction 110 is conductive, the ground voltage is imparted to the combustion reaction 110 by the combustion support structure 124.

In one embodiment, the ionizer 101 is configured substantially as described in relation to FIG. 1. The ionizer 101 can include an inner electrode 112 covered in a dielectric body 104. Outer electrodes 114 are positioned on the outside of the dielectric body 104. The outer electrodes 114 are electrically insulated from the inner electrode 112 by the dielectric body 104. Nevertheless, the outer electrodes 114 are capacitively coupled to the inner electrode 112. The outer electrodes 114 are separated from the combustion reaction 110 by a dielectric gap 120 containing a dielectric gas such as air or flue gas.

The power supply 116 is configured to supply a high-voltage to the inner electrode 112 of the ionizer 101. Due to capacitive coupling between the inner electrode 112 and the outer electrodes 114, when the power supply 116 supplies the high-voltage to the inner electrode 112, a high-voltage is also induced on the outer electrodes 114.

The combustion reaction 110 can be manipulated by applying respective voltages to the inner electrode 112 and to the combustion reaction 110. In particular, the combustion reaction can be manipulated to change the color of the combustion reaction 110, to make the combustion reaction 110 not apparent, to stretch the length of the flame, to contract length of the flame, to more thoroughly combust the fuel, to reduce pollutants, etc.

Typically, as shown in FIG. 7, the ionizer 101 is separated from the combustion reaction 110 by dielectric gap 120. However, it is possible in some circumstances that direct contact will occur between the combustion reaction 110 and one or more of the outer electrodes 114. In some circumstances it is even possible that the ionizer 101 will be intentionally positioned within the combustion reaction 110. In the event that the ionizer 101 is in direct contact with the combustion reaction 110, a short circuit of the power supply 116 is prevented because the outer electrodes 114 are electrically insulated from the power supply 116 by the dielectric body 104 covering the inner electrode 112. Thus, in the event of accidental or intentional contact between the ionizer 101 and the combustion reaction 110, a short circuit will not occur.

Figure 8:
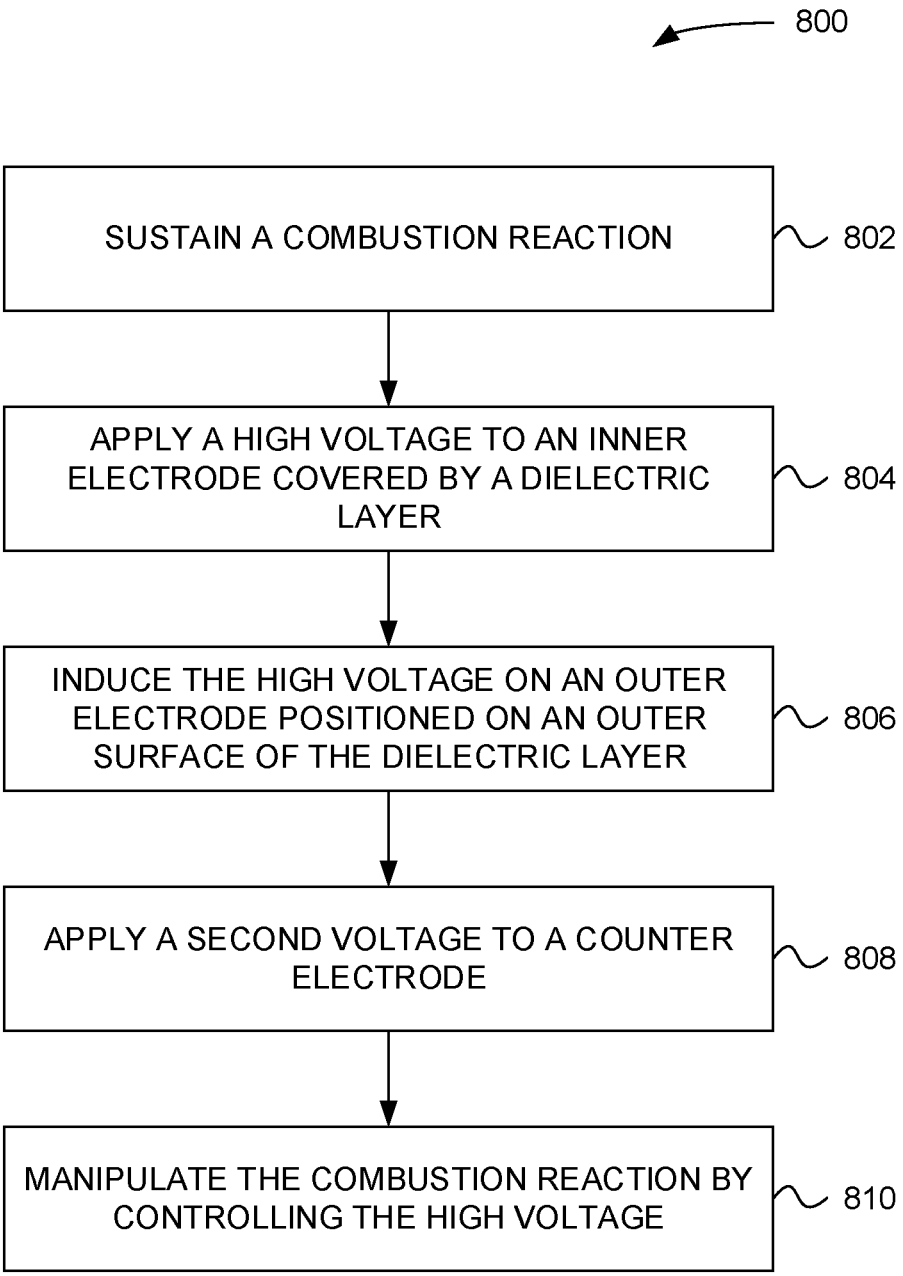
FIG. 8 is a flow diagram, of a process for operating a combustion system, according to one embodiment.

FIG. 8 is a flow diagram of a process 800 for operating a combustion system, according to one embodiment. At 802, a combustion reaction is implemented and sustained in the combustion system. The combustion reaction can include combustion between a fuel and oxygen source injected into the combustion volume.

At 804, a high-voltage is applied to an inner electrode of an ionizer. The inner electrode of the ionizer is covered by a dielectric body. An electrode is positioned on the outside of the dielectric body. The outer electrode is electrically insulated from the inner electrode by the dielectric body. Nevertheless, the outer electrode is capacitively coupled to the inner electrode by the dielectric body.

At 806, a high-voltage is induced on the outer electrode by the capacitive coupling between the electrode and the inner electrode. Thus, when the high-voltage is applied to the inner electrode, a high-voltage is induced on the electrode by capacitive coupling with the inner electrode.

At 808, a second voltage is applied to a counter electrode electrically coupled to the combustion reaction. The counter electrode can be a fuel nozzle from which fuel for the combustion reaction is emitted, a conductive mesh on which a solid fuel rests, a flame holder configured to hold the combustion reaction, or a conductor otherwise positioned in or near the combustion reaction. Because a flame conducts electricity, the second voltage is imparted to the flame by the counter electrode. At 810, a characteristic of the combustion reaction is manipulated by controlling the high-voltage. The high-voltage induces a strong electric field adjacent to the electrode of the ionizer. The strong electric field can eject charges from the electrode, can attract charges to the electrode, can cause ions or charged particles within the flame to behave in a certain way, etc. In this way a desired effect can be introduced in the combustion reaction by applying respective voltages to the inner electrode and the counter electrode. In the foregoing description, an ionizer or ion source has been described. Nevertheless, in some embodiments the ionizer or ion source may not, in fact, be a source of ions, but may instead merely manipulate a combustion reaction by influencing via electric field/electric potential ions or free charges already present in the combustion reaction. Nevertheless, the terms ionizer and ion source still apply to such other embodiments even if the function is not to ionize or act as an ion source.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system, comprising:

a combustion support structure configured to support a combustion reaction;

an ionizer including:

a dielectric body having an inside surface and an outside surface, the dielectric body being configured to maintain high electrical resistance in the presence of the combustion reaction;

an inner electrode disposed inside the dielectric body and configured to receive a high voltage from a voltage supply, the inner electrode being electrically insulated from the combustion reaction; and one or more outer electrodes disposed outside the dielectric body in capacitive communication through the dielectric body with the inner electrode; and a high voltage power supply having a ground node and a voltage output node operatively coupled to the inner electrode and configured to output a periodic high voltage signal;

wherein the periodic high voltage signal is selected to cause ejection of electrical charges from the one or more outer electrodes into a gap between the one or more outer electrodes and the combustion reaction, the ejection of electrical charges being periodic and synchronous with the periodic high voltage signal.

2. The combustion system of claim 1 wherein the periodic high voltage signal includes a first portion characterized by a high positive voltage; and wherein the one or more outer electrodes receive electrons from the gap during the positive voltage portion of the periodic high voltage signal.

3. The combustion system of claim 1, wherein the periodic high voltage signal includes a second portion characterized by a high negative voltage; and wherein the one or more outer electrodes eject electrons into the gap during the high negative voltage portion of the periodic high voltage signal.

4. The combustion system of claim 1, wherein the periodic high voltage signal includes an alternating current (AC) voltage waveform.

5. The combustion system of claim 1, wherein the periodic high voltage signal includes a direct current (DC) chopped voltage waveform.

6. The combustion system of claim 1, wherein the dielectric body includes fused quartz.

7. The combustion system of claim 1, wherein the combustion support structure is disposed for at least periodic electrical continuity with the combustion reaction.

8. The combustion system of claim 7, wherein the combustion support structure is in electrical continuity with the ground node of the high voltage power supply.

9. The combustion system of claim 7, wherein the combustion support structure is electrically isolated from electrical ground.

10. The combustion system of claim 1, wherein the one or more outer electrodes are shaped to cause an electric field curvature in the gap between the one or more outer electrodes and the combustion reaction.

11. The combustion system of claim 1, wherein the one or more outer electrodes include a metal.

12. The combustion system of claim 11, wherein the one or more outer electrodes include stainless steel.

13. The combustion system of claim 11, wherein the one or more outer electrodes include Inconel.

14. The combustion system of claim 1, wherein the one or more outer electrodes include a semiconductor.

15. The combustion system of claim 1, wherein the one or more outer electrodes include a p-doped semiconductor material configured to receive electrons from the dielectric gap adjacent to the electrode during a time interval when the inner electrode is at a high positive voltage and to minimize an ejection of electrons to the dielectric gap adjacent to the electrode during a time interval when the inner electrode is at a negative voltage.

16. The combustion system of claim 1, wherein the one or more outer electrodes include an n-doped semiconductor material configured to eject electrons to the dielectric gap adjacent to the one or more outer electrodes during a time interval when the inner electrode is at a high negative voltage and to minimize a receipt of electrons from the dielectric gap adjacent to the one or more outer electrodes during a time interval when the inner electrode is at a positive voltage.

17. The combustion system of claim 1, wherein the one or more outer electrodes include both p-doped semiconductor outer electrodes and n-doped semiconductor outer electrodes;

the one or more p-doped semiconductor outer electrodes being configured to receive electrons from the dielectric gap adjacent to the electrode during a time interval when the inner electrode is at a positive voltage; and the one or more n-doped semiconductor outer electrodes being configured to eject electrons into the dielectric gap adjacent to the electrode during a time interval when the inner electrode is at a negative voltage.

18. The combustion system of claim 17, wherein the p-doped and n-doped semiconductor outer electrodes are arranged in an interleaved pattern on the surface of the dielectric body.

19. The combustion system of claim 18, wherein the one or more n-doped semiconductor outer electrodes act to increase electric field curvature around the one or more p-doped semiconductor outer electrodes during a time interval when the inner electrode is at a positive voltage.

20. The combustion system of claim 18, wherein the one or more p-doped semiconductor outer electrodes act to increase electric field curvature around the one or more n-doped semiconductor outer electrodes during a time interval when the conductor is at a negative voltage.

21. A system comprising:

a combustion support structure configured to emit fuel for a combustion reaction;

a voltage source; and an ionizer positioned adjacent the combustion support structure and including:

an inner electrode configured to receive a first voltage signal from the voltage source;

a dielectric body covering the inner electrode; and a first outer electrode positioned on the dielectric body and configured to apply an electric field to the combustion reaction by capacitive coupling of the first outer electrode with the inner electrode;

wherein the system is configured such that, when a high voltage is applied to the inner electrode, a high voltage is induced on the outer electrode via the capacitive coupling.

22. The system of claim 21, wherein the combustion support structure is a conductor configured to receive a second voltage signal from the voltage source.

23. The system of claim 22, wherein the second voltage signal is ground.

24. The system of claim 21, wherein the first outer electrode includes a doped semiconductor having a first dopant type.

25. The system of claim 24, comprising a second outer electrode positioned on the dielectric body and capacitively coupled to the inner electrode, wherein the second outer electrode has a second dopant type.

26. The system of claim 21, wherein the dielectric body has a circular cross-section.

27. The system of claim 21, wherein the dielectric body has a rectangular cross-section.

28. The system of claim 21, wherein the outer electrode is a sharp electrode.

29. The system of claim 21, wherein the ionizer is separated from the combustion reaction by a dielectric gap.

30. The system of claim 21, wherein the first voltage signal is a periodic voltage signal.

* * * * *